US009936746B1

(12) United States Patent
Park

(10) Patent No.: US 9,936,746 B1
(45) Date of Patent: Apr. 10, 2018

(54) CONVERTIBLE GARMENT

(71) Applicant: Peak Theory, Inc., Palo Alto, CA (US)

(72) Inventor: Zachary I. Park, Venice, CA (US)

(73) Assignee: Peak Theory, Inc., Palo Alto, CA (US)

( * ) Notice: Subject to any disclaimer, the term of this patent is extended or adjusted under 35 U.S.C. 154(b) by 0 days.

(21) Appl. No.: 15/669,708

(22) Filed: Aug. 4, 2017

(51) Int. Cl.
*A41D 15/04* (2006.01)
*A41D 11/00* (2006.01)

(52) U.S. Cl.
CPC ..... *A41D 15/04* (2013.01); *A41D 11/00* (2013.01); *A41D 2200/20* (2013.01); *A41D 2400/422* (2013.01)

(58) Field of Classification Search
CPC .... A41D 15/04; A41D 11/00; A41D 2200/20; A63H 3/003; A63H 3/02
USPC ..... 2/84, 108
See application file for complete search history.

(56) References Cited

U.S. PATENT DOCUMENTS

| | | | | |
|---|---|---|---|---|
| 9,573,073 | B1 * | 2/2017 | Mazur | A63H 33/004 |
| 2004/0181844 | A1 * | 9/2004 | Kim | A41D 3/02 2/93 |
| 2008/0115254 | A1 * | 5/2008 | Galkov | A41D 3/00 2/108 |
| 2013/0042383 | A1 * | 2/2013 | Ryan | A41D 15/00 2/84 |
| 2015/0111459 | A1 * | 4/2015 | Anderman | A63H 3/003 446/27 |

* cited by examiner

*Primary Examiner* — Katherine Moran
(74) *Attorney, Agent, or Firm* — DLA Piper LLP

(57) ABSTRACT

Disclosed embodiments include a convertible garment. The convertible garment may be convertible between a garment in a first configuration to a plush toy in a second configuration. In some embodiments, the garment may include a main body portion and a hood portion with an interior compartment. In some embodiments the garment may be compacted and inverted through the compartment to flip into the plush toy configuration.

14 Claims, 6 Drawing Sheets

200
203
207
206
212
204
228
222
208
211

203
206
228
230
217
205

206
217
230

217
230

217
230

224
232
L1
220
217
232
234
230B
230A
L1
232
224
234
L2
L2

L1
230A

230A
L1

230B
232
244
L1

230B
232
234
244

230B
232
244
L1
234

230B
232
L1

X AXIS
Y AXIS

CONVERTIBLE GARMENT

TECHNICAL FIELD

The present invention generally relates to garments that may be converted into a plurality of configurations, and more specifically, to sweatshirts that may be converted between a garment configuration and a toy configuration.

BACKGROUND

Various types of garments are available to consumers in the marketplace. Likewise, various types of toys are available. Further, combination garments and toys, hooded blankets and stuffed toys, and hooded sweatshirts and stuffed pillows are also available.

However, there remains a need for an improved convertible garment and toy combination that may be efficiently converted between garment and toy configurations, substantially lightweight, aesthetically pleasing, and/or substantially durable.

SUMMARY

Various embodiments of the present invention provide a new and improved convertible garment and plush combination. Various embodiments will provide a garment that may be converted into a plush (such as a toy) and back into a garment as desired by a user. Various embodiments provide a convertible garment with improved aesthetics that reduces and ideally minimizes the visual differences between a traditional garment and the convertible garment and toy combination. Various embodiments provide a convertible garment with improved fasteners, for example, less visible or more concealed fasteners. Various embodiments provide a convertible garment with improved arrangement or position of a plush portion of the garment when stowed in a garment configuration. Various embodiments provide a convertible garment and toy combination with improved ease of convertibility between the different configurations. These and other embodiments are discussed in greater detail in the detailed description and drawing FIG.s.

In certain embodiments, a convertible garment is provided that includes a garment in a first configuration and a plush (such as a toy) in a second configuration. The convertible garment is convertible from the first configuration into the second configuration and from the second configuration into the first configuration. In some embodiments, the garment includes a main body portion and a hood portion. The hood portion includes inner and outer surfaces, and a compartment formed between the inner surface and the outer surface. Such example compartments may be accessible via an opening configured to be opened and closed by a fastener. In such examples, such a fastener may be configured to translate in a generally horizontal direction along an axis extending substantially transverse to a longitudinal axis of the garment. In some embodiments, the orientation of the fastener may be another orientation such as vertical, diagonal or other orientation. In some embodiments, opposing outer sides of the toy may be configured to be stowed within the compartment when the convertible garment is in the first configuration. In some embodiments, the toy may be positioned generally horizontally when stowed within the compartment.

BRIEF DESCRIPTION OF THE DRAWINGS

For a better understanding of the embodiments described in this application, reference should be made to the Detailed Description below, in conjunction with the following drawings in which like reference numerals refer to corresponding parts throughout the figures.

DETAILED DESCRIPTION

Figure 1A:
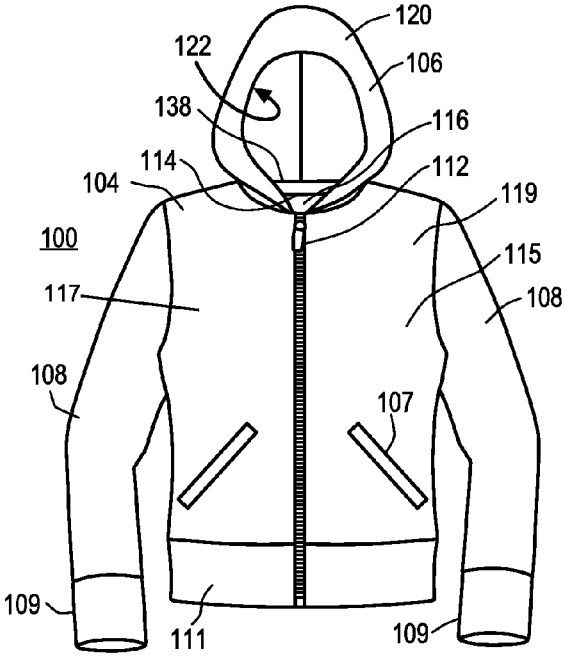
FIGS. 1A-1B are front and rear views, respectively, of a convertible garment and toy combination in a first configuration according to embodiments disclosed here.

Reference will now be made in detail to embodiments, examples of which are illustrated in the accompanying drawings. In the following detailed description, numerous specific details are set forth in order to provide a sufficient understanding of the subject matter presented herein. But it will be apparent to one of ordinary skill in the art that the subject matter may be practiced without these specific details. Moreover, the particular embodiments described herein are provided by way of example and should not be used to limit the scope of the invention to these particular embodiments. In other instances, well-known data structures, timing protocols, software operations, procedures, and components have not been described in detail so as not to unnecessarily obscure aspects of the embodiments of the invention.

The present invention describes various embodiments of convertible garment and toy combinations and associated methods for converting between garment and toy configurations. In various embodiments, the convertible garment and toy combinations described herein may provide improved aesthetics, ease of conversion, durability, weight, wearability and/or fastener or toy concealment and/or arrangement over other garment and toy combinations.

Certain details are set forth in the following description and in FIGS. 1A-5B to provide a thorough understanding of various embodiments of the present invention. Other details describing well-known structures and systems often associated with garments, toys, fasteners, etc., however, are not set forth below to avoid unnecessarily obscuring the description of the various embodiments of the present invention.

Many of the details, dimensions, angles and other features shown in FIGS. 1A-5B are merely illustrative of particular embodiments of the present invention. Accordingly, other embodiments may include other details, dimensions, angles and features without departing from. the spirit or scope of the present invention. In addition, those of ordinary skill in the art will appreciate that further embodiments of systems described herein may be practiced without several of the details described below. Various embodiments of the present invention may also include structures other than those illustrated in the FIG.s and are expressly not limited to the structures shown in the FIG.s. Moreover, the various elements and features illustrated in the FIG.s may not be drawn to scale. In the FIG.s, identical reference numbers identify identical or at least generally similar elements. To facilitate the discussion of any particular element, the most significant digit or digits of any reference number refers to the FIG. in which that element is first introduced. For example, element 104 is first introduced and discussed with reference. to FIG. 1.

As used herein, the term "substantially" refers to the complete or nearly complete extent or degree of an action, characteristic, property, state, structure, item, or result. For example, an object that is "substantially" concealed or hidden would mean that the objects are either completely or nearly completely concealed or hidden. The exact allowable degree of deviation from absolute completeness may in some cases depend on the specific context. However, generally speaking the nearness of completion will be so as to have the same overall result as if absolute and total completion were obtained.

As used herein, the term "about" is used to provide flexibility to a numerical range endpoint by providing that a given value may be "above" or "below" the value. For example, the given value modified by about may be, for example, by ±5%, ±10%, ±15%, ±20%, or any value therebetween.

Wherever used throughout the disclosure and claims, the term "generally" has the meaning of "approximately" or "closely" or "within the vicinity or range of". The term "generally" as used herein is not intended as a vague or imprecise expansion on the term it is selected to modify, but rather as a clarification and potential stop gap directed at those who wish to otherwise practice the appended claims, but seek to avoid them by insignificant, or immaterial or small variations. All such insignificant, or immaterial or small variations are intended to be covered as part of the appended claims by use of the term "generally".

As used herein, the singular forms "a", "an", and "the" are intended to include the plural forms as well, unless the context clearly indicates otherwise. It will be further understood that the terms "includes" and/or "including", when used in this specification, specify the presence of stated. features, integers, steps, operations, elements, and/or components, but do not preclude the presence or addition of one or more other features, integers, steps, operations, elements, components, and/or groups thereof.

Spatially relative terms, such as "beneath" "below", "lower", "above","upper", "front", "rear", "interior", "exterior", and the like, may be used herein for ease of description to describe one element or feature's relationship to another element(s) or feature(s) as illustrated in the figures. It will be understood that the spatially relative terms are intended to encompass different orientations of the convertible garment and toy combination in use or operation in addition to the orientation depicted in the figures. For example, if the convertible garment and toy combination in the figures is turned over or inverted, elements described as "below" or "beneath" other elements or features Would then be oriented "above" the other elements or features. Thus, term such as "below" may encompass both an orientation of above and below. The convertible garment and toy combination may be otherwise oriented (rotated 90 degrees or at other orientations) and the spatially relative descriptors used herein are interpreted accordingly.

Although the terms first, second, etc. may be used herein to describe various figurations, elements, components, regions, layers and/or sections, it should be understood that these configurations, elements, components, regions, layers and/or sections should not be limited by these terms. These terms are used only to distinguish one configuration,element, component, region, layer, or section from another region, layer, or section. Thus, a first configuration, element, component, region, layer, or section discussed below could be termed a second configuration, element, component, region, layer, or section without departing from the teachings of the present invention.

As used herein, the terms "and/or" and "at least one of" include any and all combinations of one or more of the associated listed items.

As used herein, the term "garment" may include, but is not limited to, a hooded sweatshirt, crew neck sweatshirt, v-neck sweatshirt, vest, shirt, robe, sweater, jacket, towel, blanket, and/or cape.

As used herein, the term "toy" may include, but is not limited stuffed toys, plush toys, toys looking like bugs, creatures, aliens, dolls, mascots, characters from animated TV series, movies, or shows, vehicles, cars, helicopters, planes, tanks, boats, consumer electronics, furniture, plants, trees, flowers, buildings, appliances, company logos, numbers and/or letters. The second configuration of the garment, as described below, could take the shape of any of these or other plush objects.

Figure 1B:
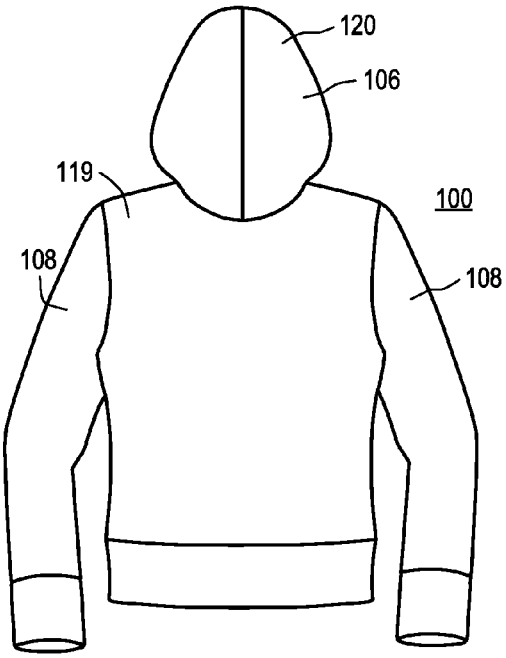

Referring now to the drawing FIG.s, FIGS. 1A-1B show a convertible garment and toy combination 100 in a first configuration 104, according to an embodiment of the present invention. In this example, the first configuration is in a mode of garment which may be converted to a plush toy according to the description below, but where the plush toy is hidden or otherwise compartmentalized so as not to be seen until converted. The garment 104 may be any example garment, the example shown here is a non-limiting example of a hooded sweatshirt 104 including a hood portion 106 and sleeves 108A and 108B coupled (e.g., sewn, stitched, or otherwise attached) to a main body portion 104. The hooded sweatshirt 104 may be used (e.g., worn) in a traditional or conventional manner as desired by a user (e.g., wearer, person). For example, the main body portion 104 may be worn over at least an upper body portion of the user. The sleeves 108 may cover the user's arms. In some embodiments, the garment includes a hood portion 106 which may be worn over at least a portion of the user's head and removed as desired while still being connected to the garment body 104. While illustrated as a hooded sweatshirt 104, in other embodiments, the garment 104 may be a hooded shirt, vest, robe, sweater, jacket, or other suitable garment or article of clothing as described above. Further details of the convertible garment and toy combination 100 are described below.

The hooded garment or sweatshirt 104 may include other traditional aspects of a sweatshirt or garment. For example, in some embodiments, the hooded garment 104 may include graphics anywhere on the front, back, arms, hood or other portion. The hooded garment 104 may include, one or more pockets 107, or cuff portions 109 on the sleeves 108 or cuff portions 111 on the garment body 104. As illustrated, the hooded sweatshirt 104 may also include a first fastener 112 configured to removably secure a left portion 115 of the sweatshirt 104 to a right portion 117 of the sweatshirt 104 while being worn by a user and thereby securing the garment 104 in front as shown in FIG. 1A. While illustrated as a zipper in FIG. 1A, in other embodiments, the first fastener 112 may include, but is not limited to: buttons, clasps, snaps, hook and loops (Velcro), and/or other suitable fastening and closure mechanisms.

The hooded sweatshirt 104 example in FIG. 1A includes an inner or interior side 116 (not shown except for just inside hood) (e.g., layer, surface, lining) and an outer or exterior side 119 (e.g., layer, surface, lining). The interior side 116 rests (e.g., faces) or is configured to rest against a user's body when worn (e.g., facing inwardly toward the user's body). The exterior side 119 faces outward in an opposing direction from the interior side (e.g., away from a user's body) when the garment 104 is worn. The exterior side 119 may shield a user from wind, rain, snow, or otherwise provide a layer of protection from the elements, depending on what it is made of. In some example embodiments, the exterior side 119 may be made of cotton, polyester, elastics, wool, or blends of any of these or other materials. In some embodiments, the exterior side 119 may be treated with chemical to help it be water resistant, stain resistant, wind proof or other advantageous feature.

Further, in some embodiments the hood portion 106 may also include a first exterior side 120 (e.g., a first layer, surface, lining) and a second interior side 122 (e.g., a second layer, surface, lining) that face opposing directions. In some examples the first side 120 may be an outer (e.g., exterior or outward facing) layer or surface made of one material and the second side 122 may be an inner (e.g., interior or inward facing) layer or surface made of a different material or a different cut of material than the first side 120. For example, when the hood portion 106 is worn over a user's head, the second side 122 at least contacts or rests against at least a portion of the user's head with the first side 120 being exposed to the environment.

Figure 1C:
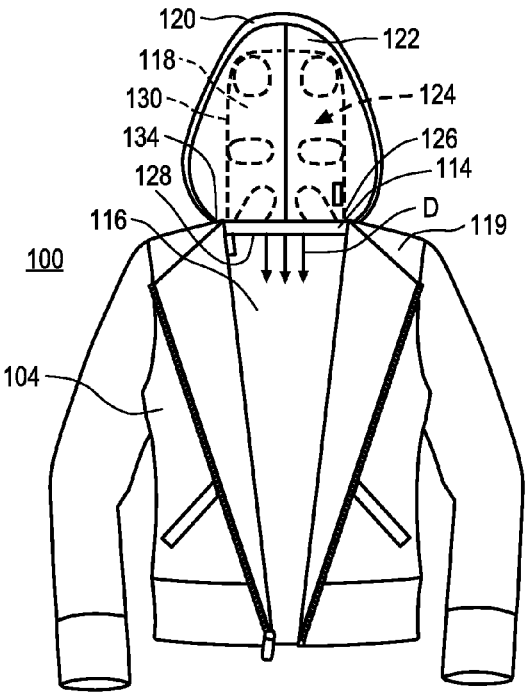
FIGS. 1C-1D are front views of the convertible garment and toy combination of FIGS. 1A-1B according to embodiments disclosed here.
Figure 1D:
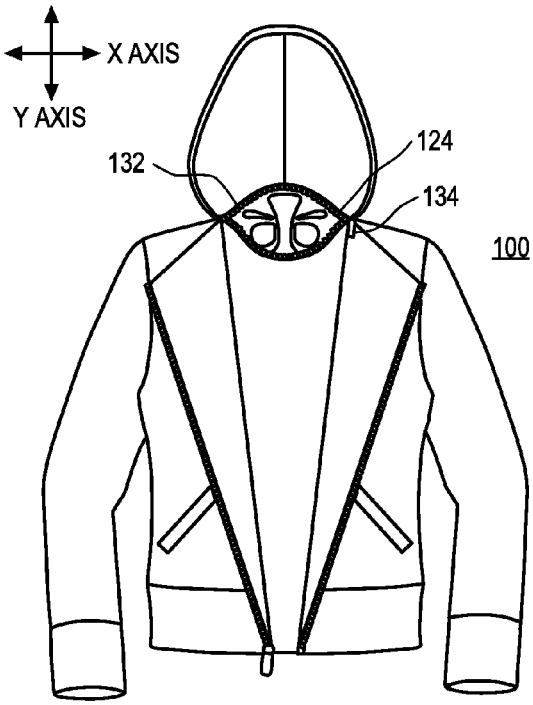

Turning to FIG. 1C-1D, in which the front of the garment 104 front fastener 112 in an open position. As in conventional hooded sweatshirts or other garments, an interior or inner collar portion 114 may be formed between a lower edge 126 of the hood 106 and an upper edge 128 of the main garment body 104 of the on the second interior side 122. In some example embodiments, the collar 114 includes a flap that conceals the opening and fastener. For example, the collar portion 114 may be positioned between or is located where the lower edge 126 of the hood 106 meets (e.g., intersects, attaches or couples to, is stitched or sewn to) the upper edge 128 of the main garment body 104. In such examples, the collar portion 114 rests against (e.g., abuts, contacts, touches) or partially circumscribes at least a portion of a user's neck, clavicle, or trapezius when the garment 104 is worn.

Further, with reference to FIGS. 1C and 1D, the hood portion 106 may include an inner compartment 124 (e.g., space, volume, gap, pocket, storage, pouch) formed between the first exterior side 120 and second interior side 122 of the hood 106. Such a compartment 124 may be formed with the two pieces of material used to make up the exterior 120 and interior 122 sides of the hood 106 in such examples. The example compartment 124 is shown in FIG. 1C illustrated in broken lines with the compartment exterior or outer sides 130 (e.g., surfaces, layers, linings). It should be noted that the shape of such compartment is not necessarily that shown in FIG. 1C but could be any shape used to store the body of the second configuration (e.g., a toy 130) when the convertible garment and toy combination 100 is in the first configuration as described herein.

Turning now to FIG. 1D, in such examples, the inner compartment 124 in the hood 106 may include a releasable opening 132 (e.g., a releasable or separable seam, slit, gap) that may be opened or closed (e.g., shut, sealed, locked) as desired by a user with a second fastener 134 as described below. In such embodiments, portions of or the entirety of the material used when the garment 104 is in the second configuration (e.g., toy, ball, letter, etc.) may be stowed within the inner compartment 124 via the opening 132. In some example embodiments, the opening 132 or seam may be formed between a lower edge portion of the hood portion 106 and an upper edge portion of the collar 114. In such examples, the opening 132 or seam may be formed by an upper portion 104 (e.g., side, half) and a lower portion 142 (e.g., side, half) releasably joined together via a second fastener 134. The second fastener 134 may be any number of fasteners such as but not limited to, a zipper, buttons, clasps, snaps, hook and loops (Velcro), and/or other suitable fastening and closure mechanisms. In certain examples, the fastener may be a reversible or two-way zipper 134 with one or two pull-tabs. Using such a fastener 134 example, the opening 132 may be opened or closed by zipping and unzipping the zipper 134 in a generally horizontal direction (e.g., as illustrated by the X axis) along an axis that is substantially parallel to a medial-lateral axis (e.g., the collar portion 114).

In other embodiments, the fastener 134 may be moved in a generally vertical direction to open and close a generally vertically oriented opening in the hood (e.g., along an axis that is substantially perpendicular to a medial-lateral axis or parallel to a superior-inferior axis). In some example embodiments, the opening 132 and corresponding fastener 134 may be oriented in a diagonal or curved shape in the hood 106. In some examples, multiple fasteners 134 and/or openings 132 may be used.

In some example embodiments, the opening 132 and/or fastener 134 may extends under the collar portion 114 or upper edge portion of the main body portion 104. While illustrated as positioned on the second interior side 122 to help conceal the fastener 134 when the garment is worn, in other embodiments (FIGS. 5A-5B), the fastener 134 and opening 132 may be formed or positioned on the first exterior side 120. In some embodiments, the fastener 134 or opening (e.g., when closed) may form an upper portion of the collar 114. In some embodiments, the opening 132 and/or fastener 134 may be positioned under the lower edge portion of the hood 106 and above an upper edge of the collar 114. In some embodiments, the opening 132 and/or fastener 134 may be positioned above the collar 114 and below an upper edge 128 of the hood 106. In some embodiments, the fastener 134 may be separately formed from the collar 114. In some embodiments, the fastener 134 may be monolithically formed with the collar 114. Similar to the first fastener 112, in some embodiments, the second fastener 134 may include, but is not limited to including: zipper, buttons, clasps, snaps, hook and loops, and/or other suitable fastening and closure mechanisms.

As illustrated in FIGS. 1A and 1B, the second fastener 134 and/or opening 132 may be at least be partially or substantially concealed or hidden when the combination 100 is in the first configuration. In certain embodiments, the second fastener 134 and/or opening 132 may include an overlapping fabric portion, flap, or cover in the collar 114. The collar 114 may be positioned over the fastener 134 to conceal or hide the fastener 134 and/or opening 132.

Figure 1E:
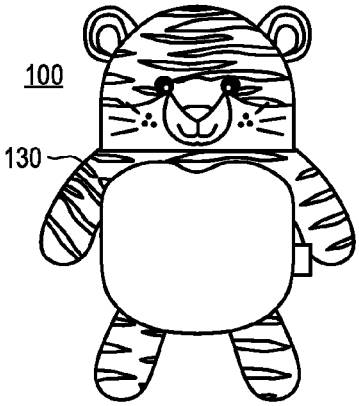
FIG. 1E is a front view of the convertible garment and toy combination of FIGS. 1A-1B in a second configuration according to embodiments disclosed here.

FIG. 1E shows the convertible garment and toy combination 100 in the second configuration where the material used in the toy 130 configuration is shown on the exterior of the combination. In such an example, the garment body 104 is completely flipped into and stored within the second configuration 130. In some examples, the second configuration is a toy 130 may be any shape as described here, including but not limited to a stuffed animal such as a tiger 130, another type of animal 130, a whale, rabbit, or bear as illustrated in other FIG.s with respect to other embodiments of the present invention. In yet further embodiments, the toy 130 may be in a form of other suitable stuffed toys or objects as described herein.

As shown in FIG. 1E example, when the combination 100 is in the second configuration as a plush toy, as illustrated in FIG. 1E, the second fastener 134 and releasable seam opening 132 extend in a generally horizontal direction (e.g., mirroring the orientation in the first configuration). In such an example, the second fastener 134 may be translated or moved to open and close the opening 132, for example, along a generally medial-lateral axis. 130130

With reference to FIGS. 1C-1D and 1F-1I, the convertible garment and toy combination 100 may be converted from the first configuration (e.g., the garment 104) into the second configuration (e.g., the toy 130) as desired by the user. Further, the convertible garment and toy combination 100 may also be converted back into the first configuration from the second configuration and vice versa as desired by the user. When the combination 100 is in the first configuration, as described above, the second fastener 134 may be manipulated to release the opening 132 into an open position from a closed position to initiate the conversion of the combination 100 into the second configuration.

Figure 1F:
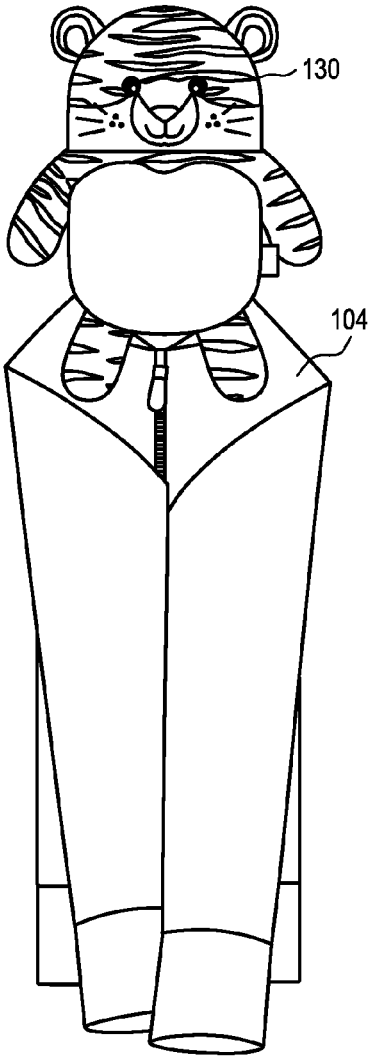
FIGS. 1F-1I are a series of front and rear views illustrating various stages of conversion of the garment and toy combination from the first configuration of FIGS. 1A-1B to the second configuration of FIG. 1E according to embodiments disclosed here.
Figure 1G:
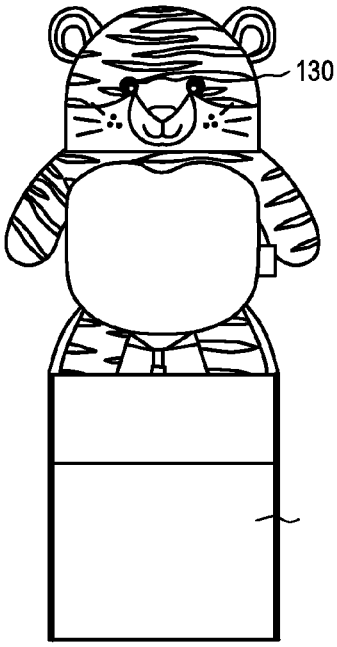
Figure 1H:
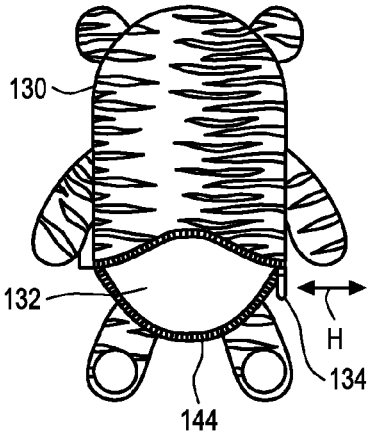
Figure 1I:
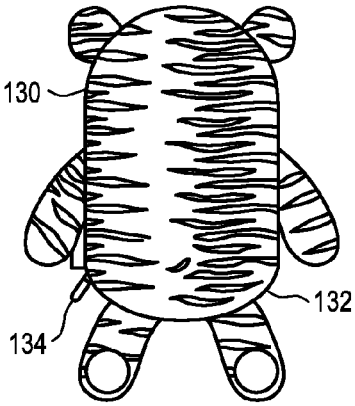

The combination 100 may be thereby folded and flipped inside the walls of the second configuration plush toy 130. FIGS. 1C-1D and 1F and 1G show the intermediary steps of converting the combination from the first garment configuration into the second plush toy configuration. The example starts with FIG. 1D and opening 132 the fastener 134 to reveal inside the hood 106 the material that makes up the second configuration plush toy 130. Next, as shown in FIG. 1F, the material that makes up the plush toy 130 is pulled out of the compartment 124 in the hood 106 but the garment portion 104 is still mostly exposed. The next steps entail folding, crumpling, or otherwise compacting the material that makes up the garment 104 so that it may fit into and inside of the walls of the second configuration stuffed toy 130. FIG. 1G shows the compacting of the garment into a folded or otherwise smaller shape 104. FIG. 1H shows the rear of the plush toy second configuration 130 and the open compartment 144 into which the compacted garment material 104 was placed. The second fastener 132 may then be closed to secure the garment material inside the body of the second configuration plush toy 130. FIG. 1I shows the second configuration plush toy 130 in its closed and fastened state, where none of the garment material 104 is showing, having been flipped and placed inside the second configuration plush toy 130 itself.

In use, turning back go FIGS. 1C and 1F, to convert from the first garment configuration 104 to the second plush toy configuration 130 the exterior sides 130 of the combination 100 in the second configuration plush toy 130 maybe pulled through the released opening 132. The material that makes up the body of the plush toy 130 may be pulled by a user in a substantially downward direction (e.g., as illustrated by the arrows D in the Y axis direction FIG. 1C) out of the opening 132, effectively flipping or turning the exterior sides right-out or in an opposite orientation relative to how they are stowed. With reference to FIG. 1F, once the exterior sides of the toy 130 are pulled out of the opening 132, both the toy 130 and garment 104 may be visible or exposed in an intermediate configuration between the first and second configurations.

Next, portions of the garment 104 (e.g., base portion, sleeves, hood portion) may be folded, rolled, crumpled, or otherwise compacted and stowed inside the second interior compartment 144 of the toy 130 (FIGS. 1G-1H) through the opening 132 at the lower edge or base portion of the toy 130. The portions of the first configuration (e.g., garment 104) effectively form the "stuffing" for the stuffed or plush toy 130. The second fastener 134 may then be used to close the opening 130 to substantially or completely secure and conceal the portions of the first configuration inside the second interior compartment 144 (FIG. 1I). This results in the second configuration (e.g., toy 130) as illustrated in FIG. 1E. The combination may be converted back into the first configuration by reversing the above steps.

FIGS. 1F-1G illustrate examples where the garment 104 generally "right-side out" to be folded or rolled into the inner toy compartment. In other embodiments, the garment portions may be turned or flipped "inside-out" and then rolled or folded into the inner to compartment to be concealed in the second configuration.

FIG. 1H shows an example of the rear of the combination 100 in the plush toy second configuration 130. In this example, the garment 104 is flipped into the walls of the plush toy second configuration 130 thereby forming a second interior compartment 144 which may be secured by the second fastener 134. The second fastener 134 or opening 132 may extend along and form (e.g., when closed) a lower (e.g., bottom, base) edge or portion of the second configuration 130 when converted. And FIG. 1I shows an example of second configuration plush toy 130 includes the entirety of the garment portions 104 inside the compartment 144 and the fastener 134 is secure, thereby closing the compartment opening 132.

It should be noted that the embodiments showing the compartment in the hood 160 or collar 114 may be moved. In some embodiments, the compartment may be located in the pocket 107 of the garment 104 or an interior pocket (not shown). Any combination or variation of placing the compartment that the garment may reverse into, to convert from a first configuration to a second configuration may be used, the examples of the hood and collar here being merely exemplary and not limiting.

Figures 2A, 2B, 2C, 2D, 2E, 2F, 2G, 2H, 2I, 2J, 2K, 2L, 2M:
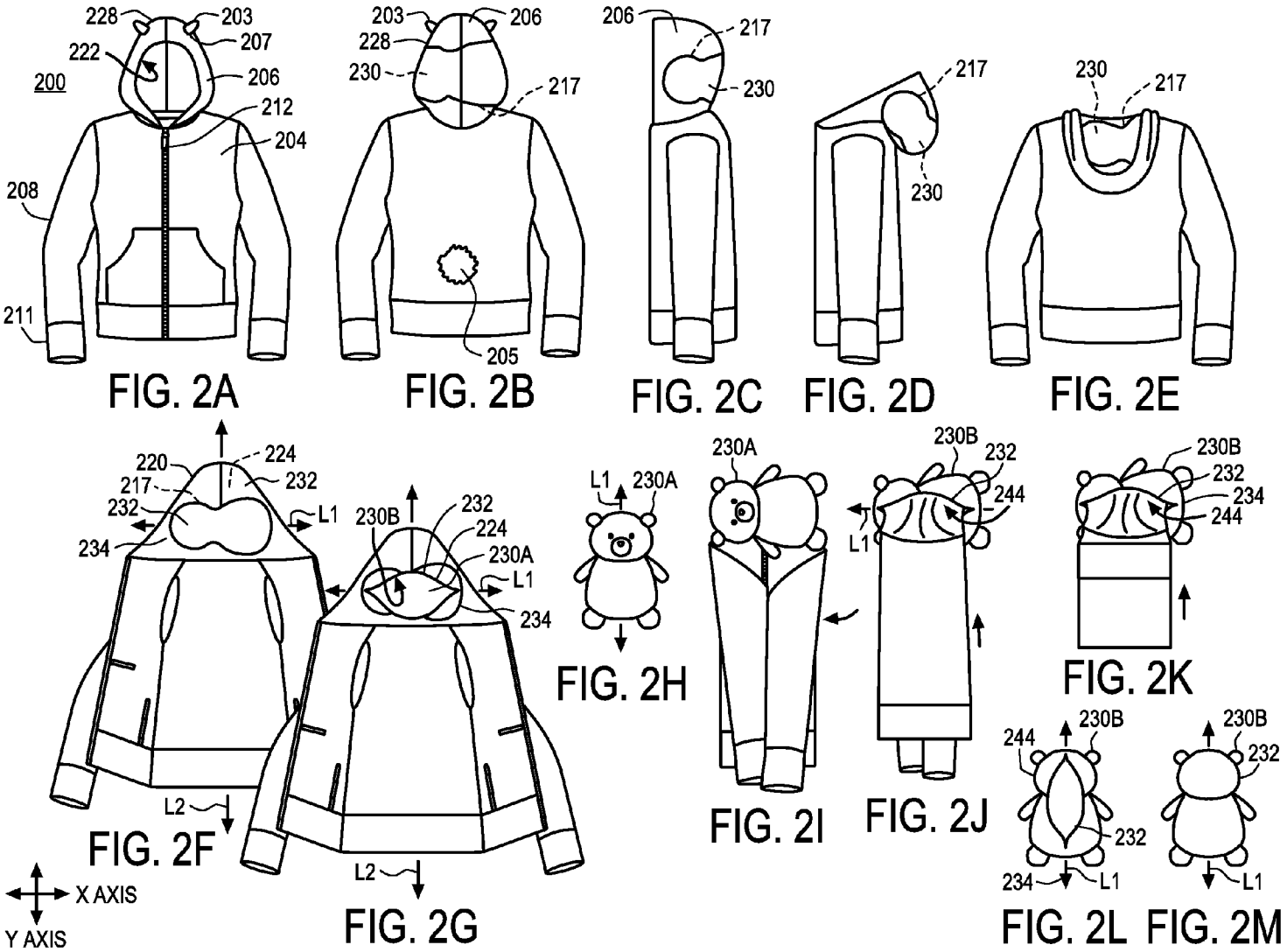
FIGS. 2A-2B are front and rear views, respectively, of a convertible garment and toy combination in a first configuration according to another embodiment of the present invention.
FIG. 2C is a side view of the convertible garment and toy combination of FIGS. 2A-2B according to embodiments disclosed here.
FIGS. 2D and 2E are a side view and a rear view, respectively, of the convertible garment and toy combination of FIGS. 2A-2B according to embodiments disclosed here.
FIGS. 2F-2G are front views of the convertible garment and toy combination of FIGS. 2A-2B according to embodiments disclosed here.
FIG. 2H is a front view of the convertible garment and toy combination of FIGS. 2A-2B in a second configuration according to embodiments disclosed here.
FIGS. 2I-2M are a series of front and rear views illustrating various stages of conversion of the garment and toy combination from the first configuration of FIGS. 2A-2G to the second configuration of FIG. 2H according to embodiments disclosed here.

Referring now to FIGS. 2A-2M, these FIG.s illustrate a convertible garment and toy combination 200 according to some embodiments of the present invention(s). The combination 200 examples in FIGS. 2A-2M may include one or more of any of the features (e.g., fasteners, garment portions, toy portions, compartments, etc.) of garment and toy combination 100, in whole or in part, as described above. The combination 200 is shown in a first garment configuration 204 in FIGS. 2A-2F along with the second plush toy 130 configuration. The combination 200 may be converted form the first garment configuration 204 in FIG. 2A and FIG. 2B into a second plush toy configuration 230 as illustrated in FIG. 2H and FIG. 2M as well as back again. While certain embodiments illustrated here depict the second configuration 230 as a toy bear, in other embodiments, the plush toy 230 may be in the form of any other kind of stuffed and/or plush toy as described herein. Similar to the embodiment of FIGS. 1A-1I, the garment 204 may be a hooded sweatshirt or any other type of garment as described above, even embodiments with a hood or without a hood. Optionally, when in the first garment configuration 204 other ornamental features may be included. For example, in some example embodiments, the garment 204 may include toy or animal appendages for example, ears 203 and, tails 205, as illustrated in FIGS. 2A-2B. Other example animal features may be whiskers, noses, spikes, claws, paws, manes, scales, feathers, fur, or other features. It is important to note that any of the animal features described herein may not be actual animal skins or taxidermy but man-made materials made to look like animal features using non-animal products and materials. These features may be attached to the garment configuration 204 on the hood 206, body 204, sleeve 208, cuff 211, or other garment portions. For example, the hood 206 may have fur around its entire opening. Further, in some embodiments, these features may be retractable (e.g., tucked or stowed) within linings, layers, or recesses 207 next to or around the corresponding garment portions they are coupled to or extend from such that they are concealed (e.g., see FIGS. 2C-2E). In some embodiments, the animal tails/ears/appendages may be detachably coupled to garment portions by Velcro, button, slide, zipper, or other attachment.

FIGS. 2A-2C illustrate the combination 200 example in the first configuration as a garment 204, and more particularly, as the hooded sweatshirt. In the example shown, a hood portion 206 of the garment 204 is in a first position, an up or worn position (e.g., when positioned over or resting on at least a portion of a user's head). FIGS. 2D-2E illustrate the hood portion 206 in a second position, down or unworn position (e.g., when positioned off or away from a user's head, resting against a back or rear side of the garment 204). A user may choose to wear the hood portion 206 in the first or second positions and move the hood portion between the two positions as desired.

FIGS. 2B-2G also illustrate a periphery or outline (e.g., in broken lines 217) of outer or exterior surfaces 230 (e.g., sides) of the material used in the plush toy configuration 230 stowed within the hood portion 206 such that the surfaces are hidden (e.g., not visible, concealed). In some example embodiments, when the combination 200 is in the first configuration, concealing the plush toy surfaces 230 may provide the appearance of a conventional or traditional garment 204 by hiding the material used to make the body of the plush toy 230 when in that second configuration. As illustrated, the plush toy 230 may be positioned in a generally horizontal position inside the hood 206 (e.g., laying on its side if the garment 204 is in an upright wearable direction). For example, when the hood portion 206 is in the first or up position as illustrated, the toy 230 generally follows a semi-circular curve of the hood portion 206 to wrap around a head of a wearer (not pictured). The plush toy 230 may wrap-around or extend in a generally U-shaped path or configuration from a first lateral side of the hood portion 206 to a second opposing lateral side of the hood portion 206. For example, a head portion (e.g., superior end) of the plush toy 230 may be positioned more proximate a first lateral side and a bottom or tail portion (e.g., inferior end) of the plush toy 230 may be positioned more proximate an opposing lateral side of the hood portion 206. 230

Example side views of the combination 200 with the hood portion 206 in the up and down positions are illustrated in FIGS. 2C and 2D, respectively. By positioning the material that makes up the plush toy 230 along a generally U-shaped, wrap-around, and/or horizontal manner as described above in the hood 206, a weight or mass of the material used to make the plush toy 230 may be more evenly (e.g., uniformly) distributed around the hood portion 206 and/or user's neck area. The plush toy 230 may also at least be partially held or supported by a user's neck, collar, and/or shoulders when the hood portion 206 is in the up position and worn by the user. This may provide improved comfort or usability of the hood portion 206. In some embodiments, the hood portion 206 may more easily remain or is more easily maintained in the up position when the toy 230 is oriented, positioned, or stowed in such a manner. Positioning the toy surfaces in such a manner may also provide improved comfort when the hood portion 206 is in the down position. For example, a center of mass of the plush toy 230 may be relatively closer or more proximate to a user's neck area compared to a toy stowed in a different orientation or manner. A pulling force or torque upon a user's neck or collar may be decreased as a center of mass of the toy 230 is positioned closer or more proximate to a user's neck area.

Alternatively or additionally, FIGS. 2F-2G, shows an example embodiment with a releasable opening 232 (e.g., seam, slit, gap) that may extend between opposing lateral sides of the hood portion 206 in a generally horizontal X axis direction (e.g., a medial-lateral axis of the hood portion 206 or a longitudinal axis L1 of the toy 230) generally transverse to a vertical axis (e.g., a superior-inferior axis of the hood portion 206 or a longitudinal axis L2 in the y axis direction of the garment 204). Such a horizontal opening 232 and fastener 234 may be used as described above, to house the compartment 224. In some example embodiments, the vertical Y axis (e.g., L2) may bisect the garment 204 (e.g., extend parallel to a path of a first fastener 212 or along a midline of the garment). While illustrated as extending substantially perpendicular to a vertical Y axis, in other embodiments, the releasable opening 232 may extend at an oblique angle (e.g., 30 degrees, 45 degrees, 60 degrees, 80 degrees, or any angle therebetween) relative to the vertical Y axis. Also, while illustrated as being positioned above a collar 214 (e.g., seam joining hood and main body portions) of the hood 206, in some embodiments, the releasable opening 232 may extend along, about, or form a portion of the collar 214. Further, the releasable opening 232 may be positioned within an interior space of the hood 206 to improve concealment such that the combination 200 appears as a conventional garment 204 in the first configuration. In other embodiments, the releasable opening 232 may be positioned on an outer or exterior surface of the garment 204 as described herein with respect to some embodiments.

Alternatively or additionally, in some embodiments, the releasable opening 232 may extend along the longitudinal axis L1 of the toy 230 (e.g., between head and feet or superior and inferior portions). Such an example embodiment may provide improved conversion or ease of converting the combination 200 from the garment into the toy and vice versa. In examples where the releasable opening 232 extends along the longitudinal axis L1, a relatively larger opening may be provided in the plush toy 230 (e.g., relative to an opening extending along an axis perpendicular to L1) for stuffing the garment portions into or pulling the garment portions out of, as described in more detail herein with reference to FIGS. 2I-2M when converting the combination 200 from the first configuration to the second configuration and vice versa.

Further, alternatively or additionally, as described herein, in some embodiments, the plush toy 230 may be positioned or stowed in the first configuration such that the longitudinal axis L1 transverses the longitudinal axis L2 of the garment 204 perpendicularly or at an oblique angle. In such examples, the plush toy 230 may be stowed within the inner compartment 224 (e.g., space, volume, gap, pocket, storage, pouch) formed between outside layer 220 and inside layer 222 of the hood portion 206. Further, the releasable opening 232 may be closed as illustrated in FIG. 2F and opened as illustrated in FIG. 2G. In some embodiments, a fastener 234 may be used to open and close the releasable opening 232, the fastener 234 being any number of things including but not limited to, a reversible or two-way zipper and track 236 with one or two pull-tabs. Additionally or alternatively, the example fastener 234 may be concealed or partially hidden as described above (e.g., by using a flap of or overlapping fabric with similar color as the hood portion). While illustrated, as a zipper, in other embodiments, the fastener 234 may include, but is not limited to: buttons, hook and loops, snaps, and/or other suitable fastening or closure mechanisms.

In some example embodiments, when the combination 200 is in the second configuration (e.g., as the plush toy 230) illustrated in FIG. 2H, the releasable opening 232 may extend in a generally vertical direction (e.g., along the longitudinal axis L1 along the x axis direction of the plush toy 230). In such examples, the fastener 234 may be translated along the axis L1 to open or close the releasable opening 232. In some embodiments, the longitudinal axis L1 may bisect the plush toy 230 (e.g., the fastener 234 or releasable opening 232 may extend along the midline of the plush toy 230). As described in more detail herein with respect to FIGS. 2I-2M, portions of the garment 204 may be stowed within a second interior compartment 244 formed between ornamental (e.g., front and back), outer, or exterior surfaces when in the second plush toy configuration 230 (e.g., also identified individually as first exterior front surface 230A and second exterior back surface 230B in FIG. 2I-2H) of the plush toy 230. In such configuration, portions of the garment 204 may then be secured inside by closing the releasable opening 232 with the fastener 234 to form the plush toy 230. When placed in the second plush toy configuration 230, the combination 200 may then appear as a conventional plush toy 230 without the portions of the garment configuration 204 showing or exposed.

With reference to FIGS. 2F-2G and FIGS. 2I-2M, the convertible garment and toy combination 200 may be converted from the first configuration (e.g., the garment 204) into the second configuration (e.g., the plush toy 230) and vice versa as desired by any user. When in the first garment configuration 204, the releasable opening 232 may be opened (e.g., by translating the fastener 234 along the longitudinal axis L1) as illustrated in FIG. 2G. As illustrated, in some embodiments, opposing exterior surfaces of the plush toy 230 are flipped "inside-out" when stowed in the interior compartment 224 such that the exterior surface 230A and 230B face each other (e.g., inwardly).

In some embodiments, a first exterior surface 230A may be pulled (e.g., flipped, pushed, etc.) out of the interior compartment 224 through the opening 232. While illustrated as the front or anterior surface of the toy 230, in other embodiments, the first exterior surface 230A may be the rear or posterior surface and the second exterior surface 230B may be the corresponding opposite surface. As the first exterior surface 230A is pulled out through the opening 232, the second exterior surface may be rotated (e.g., pivoted, flipped) rearward about the first exterior surface. In this manner, the exterior surfaces 230 are flipped "right-side" out as the toy surfaces are pulled out of the opening, resulting in the configuration shown in FIGS. 2I-J.

In such examples, the exterior surfaces 230 may thus be flipped and oriented or face opposing directions (e.g., outwardly) with the releasable opening 232 extending substantially parallel to or along longitudinal axis L1 and positioned on the second interior surface 230B. In other embodiments, the exterior surfaces 230 may be positioned or oriented within the compartment 224 such that the releasable opening 232 is positioned on the first interior surface 230A. The exterior surfaces 230 may be oriented in opposite orientations when outside the compartment 224 (e.g., in the second configuration) as relative to when they are stowed inside the compartment 224 (e.g., in the first configuration).

With reference to FIGS. 2I-2K, the garment 204 (e.g., sleeve portions, body portion 204, hood portion 206) may then be zipped, folded and/or rolled (e.g., illustrated by arrows) such that it may be stuffed or positioned into (e.g., within) the second interior compartment 244 of the toy 230. The releasable opening 232 may be closed as illustrated in FIGS. 2L-2M to secure the garment portions 204 inside the compartment 244 when in the second plush toy configuration 230 to complete the conversion from the garment of the first configuration to the toy of the second configuration. In such examples, a zipper fastener 234 may be used to close and open the opening 232, the fastener may be translated along an axis substantially parallel to or along L1 to close the opening and secure the garment portions within the toy 230.

Figure 3:
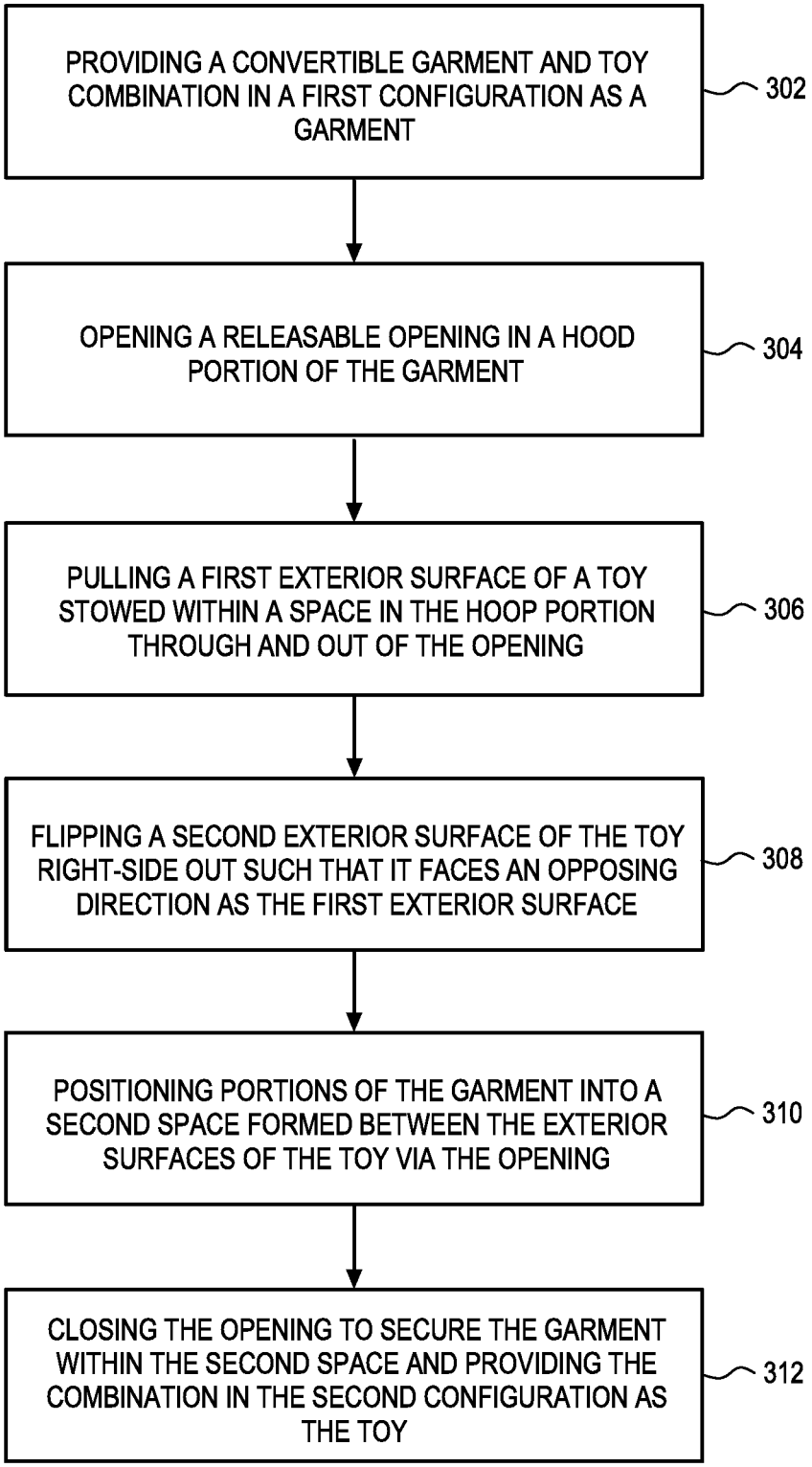
FIG. 3 schematically illustrates an example method according to embodiments disclosed here.

FIG. 3 illustrates an example method for converting a convertible garment and toy combination from a first configuration to a second configuration. The method steps may be reversed to convert the combination from the second configuration into the first configurations. The method may include providing a convertible garment and toy combination in a first configuration as a garment 302. Releasing or opening a releasable opening in a hood portion of the garment 304. The releasable seam extends along an axis substantially perpendicular to a longitudinal axis of the garment. The method can further include pulling a first exterior surface of a toy stowed within a space in the hood portion through and out of the opening 306.

The method may include flipping a second exterior surface of the toy stowed within the space such that it is "right-side" out and facing an opposing direction as the first exterior surface 308. The second exterior surface faces the first exterior surface when stowed within the space. Next, the method may include positioning, folding, rolling, and/or stuffing portions of the garment through the opening into a second space formed between the exterior surfaces of the toy to "stuff" the toy 310. The opening extends along an axis substantially parallel to a longitudinal axis of the toy. Finally, the method may include securing or closing the opening such that the garment portions are secured in the second space providing the combination in the second configuration as a toy 312.

Figure 4A:
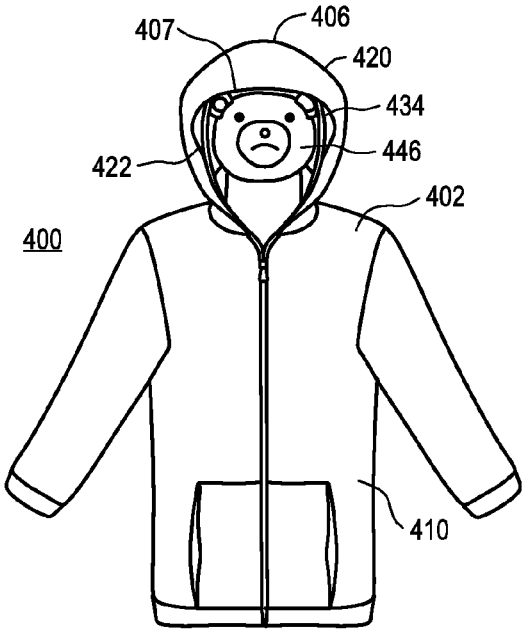
FIGS. 4A-4F example illustrations of a first configuration to a second configuration according to embodiments disclosed here.
Figure 4B:
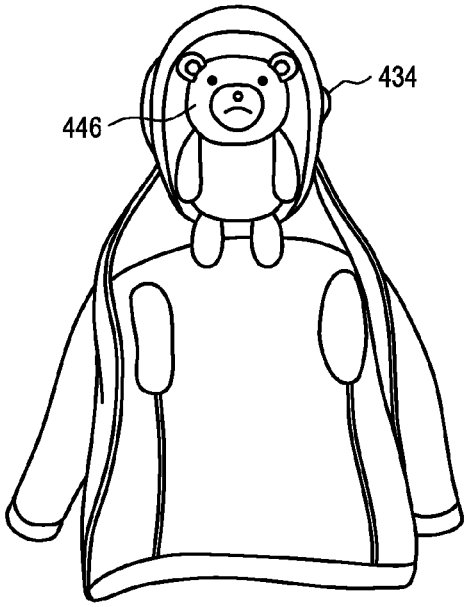
Figure 4C:
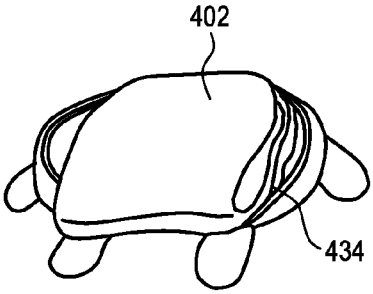
Figure 4E:
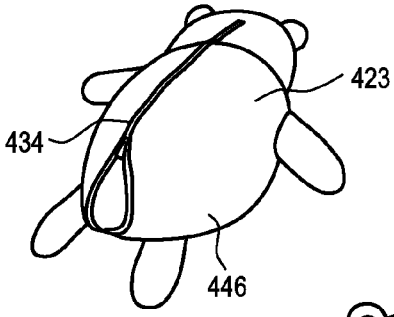
Figure 4D:
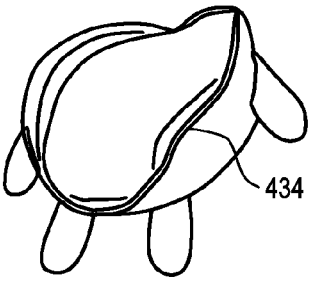
Figure 4F:
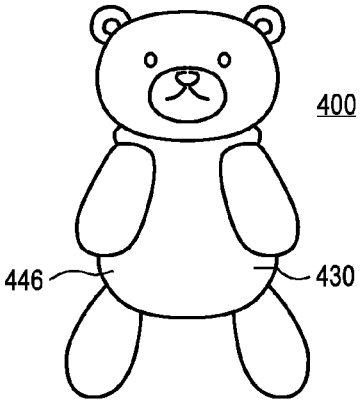
Figure 5A:
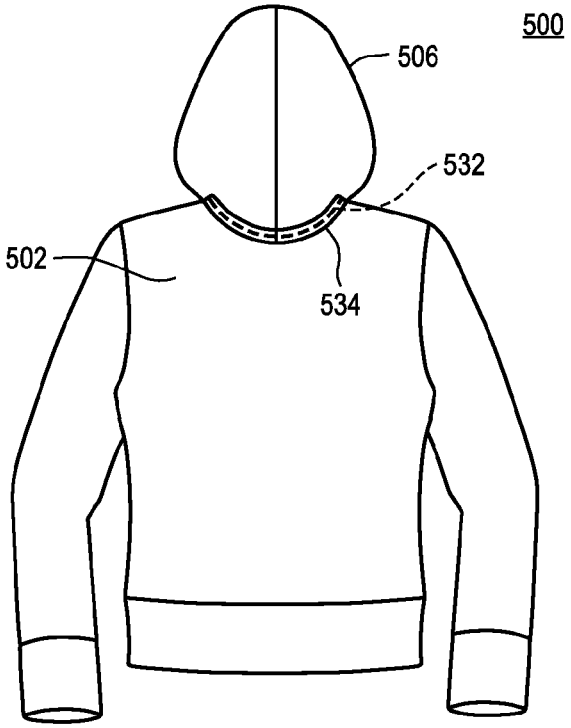
FIGS. 5A-5B are rear views of a convertible garment and toy combination in a first configuration according to embodiments disclosed here.
Figure 5B:
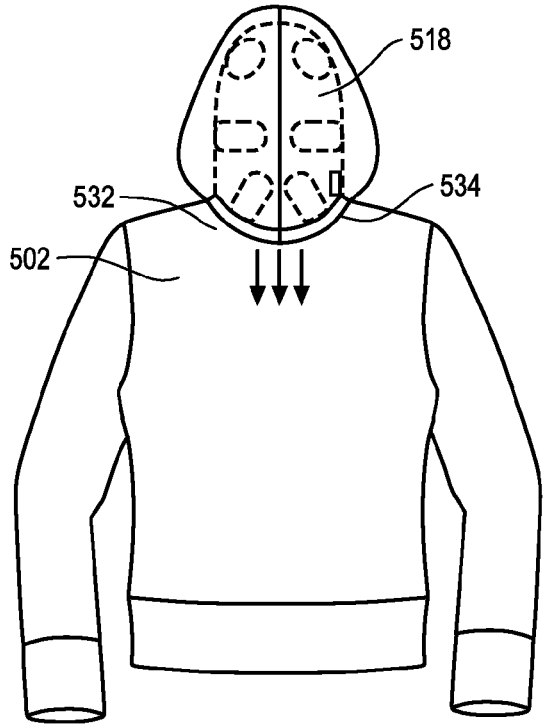

Referring now to FIGS. 4A-4F, these FIG.s illustrate a convertible garment and toy combination 400 according to some embodiments of the present invention which may be combined with any of the other features and embodiments in any way described herein. In the example, a first configuration (e.g., a garment 402) is illustrated in FIG. 4A, and a second configuration (e.g., a plush toy 430) is illustrated in FIG. 4F. Similar to the embodiment of FIGS. 1A-1B, the garment 402 may be a hooded sweatshirt 402 and include any of the features as described above with respect to the garment 104. As described in more detail below and illustrated with respect to FIGS. 4B-4E, the combination 400 may be converted from the first configuration of FIG. 4A into the second configuration of FIG. 4F and vice versa.

In these examples, a hood portion 406 of the first configuration garment 402 includes a first exterior side 420 (e.g., a first layer, surface, lining) and a second interior side 422 (e.g., a second layer, surface, lining) that face opposing directions and make up the hood 406. In the first garment configuration 402, the first side 420 is an outer (e.g., exterior or outward facing) layer or surface and the second side 422 is an inner (e.g., interior or inward facing) layer or surface. As described in more detail below, at least a portion of the second side 422 converts to an outer or exterior surface of the plush toy configuration 430 of the combination 400.

In some example embodiments, exterior or ornamental surfaces 446 of the plush toy 430 may be directly attached (e.g., printed, painted, drawn, formed) on the second interior side 422 of the hood portion 406. Such example ornamental surfaces may be a separate layer attached to the interior side 422 of the hood portion 406 (e.g., second side 422) or monolithically formed with a portion of the interior side of the hood portion 406. As illustrated in FIGS. 4A-4B, the ornamental surfaces 446 may include any design including but not limited to a face, ears, body, arms, or legs of the plush toy 430 (e.g., a bear) attached to the second side 422 of the hood portion 406. When the combination 400 is in the garment configuration 402 and the hood 406 is worn in a conventional manner, such ornamental surfaces 446 may be substantially concealed or hidden by the user's body and/or head.

In such examples, the ornamental surfaces 446 along with the interior portion 422 of the hood 406 form an exterior or outer (e.g., anterior or front and posterior or rear) surface of the plush toy in the second configuration 430. Example ornamental surfaces 446 of the plush toy 430 and may be located radially inward of the edge 407 of the hood portion 406. Further, a fastener 434 (e.g., a zipper or other fastener) may borders or enclose the ornamental surfaces 446. The hood portion 406 and main body portion 402 may be turned or flipped inside-out as illustrated in FIG. 4B such that the ornamental surface 446 and interior 422 may be exposed as outer or exterior surfaces.

Next, the main body portion 402 and sleeves 408 may be rolled, folded up, crumpled, or otherwise compacted into the compartment 444 (e.g., space, volume, etc.) formed within the ornamental surfaces 446, interior surface 422 , and fastener 434 as illustrated in FIG. 4C-4D. With reference to FIG. 4E, once the main body portion 402 and sleeves 408 are stowed within the compartment 444, the fastener 434 may be translated to close the compartment, securing and concealing the portions of the sweatshirt 402 within an interior of the toy 430 and converting into the second configuration. The combination 400 may be returned to the first configuration by reversing the steps described above.

As described above and illustrated in FIGS. 5A-5B, according to some embodiments of the present invention(s), openings 532 and fasteners 534 may be positioned or located on an exterior surface or side of the hood 506 or main body portion of a garment 502. For example, the fastener 534 may extend along a seam formed where the hood portion attaches to the main body portion of the sweatshirt or garment 502.

From the foregoing, it be appreciated that specific embodiments of the invention have been described herein for purposes of illustration,but that various modifications may be made without deviating from the spirit and scope of the various embodiments of the invention. Further, while various advantages associated with certain embodiments of the invention have been described above in the context of those embodiments, other embodin s may also exhibit such advantages, and not all embodiments need necessarily exhibit such advantages to fall within the scope of the invention. Accordingly, the invention is not limited, except as by the appended claims.

While the above description describes various embodiments of the invention and the best mode contemplated, regardless how detailed the above text, the invention can be practiced in many ways. Details of the system may vary considerably in its specific implementation, while still being encompassed by the present disclosure. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements. Further any specific numbers noted herein are only examples: alternative implementations may employ differing values or ranges.

References throughout the foregoing description to features, advantages, or similar language do not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification ay, but do not necessarily, refer to the same embodiment.

Furthermore, the described features, advantages, and characteristics of the present invention may be combined in any suitable manner in one or more embodiments. One skilled in the relevant art will recognize that the present nvention can be practiced without one or more of the specific features or advantages of a particular embodiment. In other s additional features and advantages may be recognized in certain embodiments that may not be present in all embodiments of the present invention.

Any patents and applications and other references noted above, including any that may be listed in accompanying filing papers, are incorporated herein by reference. Aspects of the invention can be modified, if necessary, to employ the systems, functions, and concepts of the various references described above to provide yet further implementations of the invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein" "above," "below," and words of similar import, when used in this application, refer to this application as a whole and not to any particular portions of this application. Where the context permits, words in the above Detailed Description using the singular or plural number tray also include the plural or singular number respectively. The word "or", in reference to a list of two or more items, covers all of the following interpretations of the word: any of the items in the list, all of the items in the list, and any combination of the items in the list.

Although certain aspects of the invention are presented below in certain claim forms, the applicant contemplates the various aspects of the invention in any number of claim forms. Accordingly, the applicant reserves the right to pursue additional claims after filing this application to pursue such additional claim forms, in either this application or in a continuing application.

The invention claimed is:

1. A convertible garment comprising:

a garment with a main garment body attached to a hood, the hood having an exterior layer and an interior layer;

wherein the hood interior layer including a generally horizontal opening to a compartment, the compartment formed between the exterior layer of the hood and the interior layer of the hood;

a fastener affixed to the generally horizontal opening, the fastener configured to allow the compartment to open and close;

wherein the compartment includes a plush toy body, capable of inverting through the generally horizontal opening;

wherein the compartment is capable of inverting through the generally horizontal opening and the main garment body is capable of compacting into the inverted hood compartment.

2. The convertible garment of claim 1, wherein the opening is positioned as a collar between the main garment body and attached hood.

3. The convertible garment of claim 2, wherein the collar includes a flap configured to conceal the opening and fastener.

4. The convertible garment of claim 1, wherein the generally horizontal opening is a releasable seam extending along an axis extending substantially perpendicular to a longitudinal axis of the main garment body and substantially parallel to a longitudinal axis of the plush toy body.

5. The convertible garment of claim 1, wherein exterior sides of the plush toy body are positioned outside of the compartment when the convertible garment is in a second configuration.

6. The convertible garment of claim 1, wherein the opening extends along an axis substantially parallel to a longitudinal axis of the toy when the garment is in a second configuration.

7. The convertible garment of claim 6, wherein the opening extends along a rear surface of the plush toy body when the convertible garment is in a second configuration.

8. The convertible garment of claim 1, wherein the fastener is a zipper.

9. The convertible garment of claim 1, wherein the main garment body includes a front pocket.

10. A convertible garment comprising:

a garment in a first configuration;

a toy in a second configuration;

wherein the convertible garment is convertible from the first configuration into the second configuration and from the second configuration into the first configuration;

wherein the garment includes a main body affixed to a hood, wherein the hood includes inner and outer surfaces, and a space formed between the inner and outer surfaces; and wherein exterior surface of the toy is configured to be stowed within the space when the convertible garment is in the first configuration, and wherein the exterior surface portions of the toy extend in a generally U-shaped configuration from a first lateral side of the hood to a second lateral side of the hood such that the toy is oriented substantially on its side when stowed within the space wherein a longitudinal axis of the toy extends substantially perpendicular to a longitudinal axis of the garment when stowed within the space, and wherein a releasable opening positioned on the inner surface of the hood portion extends along an axis substantially perpendicular to the longitudinal axis of the garment.

11. The convertible garment of claim 10, wherein the releasable opening extends along a midline of the toy, the midline being substantially perpendicular to a midline of the garment.

12. The convertible garment of claim 10, wherein the releasable opening extends along a rear exterior surface of the toy.

13. The convertible garment of claim 10, wherein the releasable opening extends along a front exterior surface of the toy.

14. The convertible garment of claim 10, wherein garment portions are stowed and secured within a second space formed between the exterior surfaces of the toy when the convertible garment is in the second configuration.

* * * * *